US005839723A

United States Patent [19]

Grimes

[11] Patent Number: 5,839,723

[45] Date of Patent: Nov. 24, 1998

[54] MULTI-LAYER MAZE ASSEMBLY

[76] Inventor: Charles R. Grimes, 325 Lake Holley Cir., Defuniak Springs, Fla. 32433

[21] Appl. No.: 964,931

[22] Filed: Nov. 5, 1997

[51] Int. Cl.[6] ..... A63F 7/04

[52] U.S. Cl. ..... 273/109; 273/153 R

[58] Field of Search ..... 273/108, 109, 273/112, 113, 115, 116, 118 R, 153 R, 440, 441

[56] References Cited

U.S. PATENT DOCUMENTS

| | | | |
|---|---|---|---|
| 3,406,971 | 10/1968 | Koff . | |
| 3,692,311 | 9/1972 | Redo . | |
| 3,785,651 | 1/1974 | Smith | 273/153 R X |
| 4,685,679 | 8/1987 | Ben-Gal et al. | 273/109 X |
| 5,054,427 | 10/1991 | Hoover | 273/153 R X |
| 5,145,174 | 9/1992 | Caramanoff . | |
| 5,409,223 | 4/1995 | Attaya . | |
| 5,499,815 | 3/1996 | Attaya | 273/109 |

*Primary Examiner*—Raleigh W. Chiu
*Attorney, Agent, or Firm*—Joseph N. Breaux

[57] ABSTRACT

A multi-layer maze assembly that includes a steel maze ball; a top cover member having a magnetic ball storage hole, a ball storage magnet positioned adjacent to the magnetic ball storage hole, a ball insertion opening, two securing apertures, and first, second and third maze level maps; a first maze level member including first interconnected maze channels, two securing apertures, and a first maze ball pass through aperture; a second maze level member including second interconnected maze channels, two securing apertures, and a second maze ball pass through aperture that is sized to allow passage therethrough of the steel maze ball; a third maze level member including third interconnected maze channels, two securing apertures, and a third maze ball pass through aperture; and two maze assembly securing screws of each of sufficient length to pass through aligned securing apertures of the top cover member, the first maze level member, the second maze level member, and the third maze level member; the ball insertion opening being in connection with the first interconnected maze channels; the first maze ball pass through aperture being in connection with the second interconnected maze channels; the second maze ball pass through aperture being in connection with the third interconnected maze channels; the third maze ball pass through aperture being in connection with the exterior of the multi-layer game assembly.

16 Claims, 3 Drawing Sheets

MULTI-LAYER MAZE ASSEMBLY

TECHNICAL FIELD

The present invention relates to amusement games and puzzles and more particularly to a multi-layer maze assembly that includes a steel maze ball; a top cover member having a magnetic ball storage hole, a ball storage magnet positioned adjacent to the magnetic ball storage hole, a ball insertion opening sized to allow passage therethrough of the steel maze ball, two securing apertures, and first, second and third maze level maps; a first maze level member including first interconnected maze channels, two securing apertures, and a first maze ball pass through aperture that is sized to allow passage therethrough of the steel maze ball; a second maze level member including second interconnected maze channels, two securing apertures, and a second maze ball pass through aperture that is sized to allow passage therethrough of the steel maze ball; a third maze level member including third interconnected maze channels, two securing apertures, and a third maze ball pass through aperture that is sized to allow passage therethrough of the steel maze ball; and two maze assembly securing screws of each of sufficient length to pass through aligned securing apertures of the top cover member, the first maze level member, the second maze level member, and the third maze level member; the ball insertion opening being in connection with the first interconnected maze channels; the first maze ball pass through aperture being in connection with the second interconnected maze channels; the second maze ball pass through aperture being in connection with the third interconnected maze channels; the third maze ball pass through aperture being in connection with the exterior of the multi-layer game assembly; the ball storage magnet having sufficient magnetic power to attract and maintain the steel maze ball within the magnetic ball storage hole.

BACKGROUND OF THE INVENTION

It is often desirable to have an amusement device to pass the time. It would be a benefit, therefore, to have a multi-level maze device having multiple sets of maze channels that are interconnected in a level arrangement that allowed a user pass the time by attempting to move a ball through each of the maze channels.

SUMMARY OF THE INVENTION

It is thus an object of the invention to provide a multi-layer maze assembly having multiple sets of maze channels that are interconnected.

It is a further object of the invention to provide a multi-layer maze assembly that includes a steel maze ball; a top cover member having a magnetic ball storage hole, a ball storage magnet positioned adjacent to the magnetic ball storage hole, a ball insertion opening sized to allow passage therethrough of the steel maze ball, two securing apertures, and first, second and third maze level maps; a first maze level member including first interconnected maze channels, two securing apertures, and a first maze ball pass through aperture that is sized to allow passage therethrough of the steel maze ball; a second maze level member including second interconnected maze channels, two securing apertures, and a second maze ball pass through aperture that is sized to allow passage therethrough of the steel maze ball; a third maze level member including third interconnected maze channels, two securing apertures, and a third maze ball pass through aperture that is sized to allow passage therethrough of the steel maze ball; and two maze assembly securing screws of each of sufficient length to pass through aligned securing apertures of the top cover member, the first maze level member, the second maze level member, and the third maze level member; the ball insertion opening being in connection with the first interconnected maze channels; the first maze ball pass through aperture being in connection with the second interconnected maze channels; the second maze ball pass through aperture being in connection with the third interconnected maze channels; the third maze ball pass through aperture being in connection with the exterior of the multi-layer game assembly; the ball storage magnet having sufficient magnetic power to attract and maintain the steel maze ball within the magnetic ball storage hole.

It is a still further object of the invention to provide a multi-layer maze assembly that accomplishes both of the above objects in combination.

Accordingly, a multi-layer maze assembly is provided. The multi-layer maze assembly includes a steel maze ball; a top cover member having a magnetic ball storage hole, a ball storage magnet positioned adjacent to the magnetic ball storage hole, a ball insertion opening sized to allow passage therethrough of the steel maze ball, two securing apertures, and first, second and third maze level maps; a first maze level member including first interconnected maze channels, two securing apertures, and a first maze ball pass through aperture that is sized to allow passage therethrough of the steel maze ball; a second maze level member including second interconnected maze channels, two securing apertures, and a second maze ball pass through aperture that is sized to allow passage therethrough of the steel maze ball; a third maze level member including third interconnected maze channels, two securing apertures, and a third maze ball pass through aperture that is sized to allow passage therethrough of the steel maze ball; and two maze assembly securing screws of each of sufficient length to pass through aligned securing apertures of the top cover member, the first maze level member, the second maze level member, and the third maze level member; the ball insertion opening being in connection with the first interconnected maze channels; the first maze ball pass through aperture being in connection with the second interconnected maze channels; the second maze ball pass through aperture being in connection with the third interconnected maze channels; the third maze ball pass through aperture being in connection with the exterior of the multi-layer game assembly; the ball storage magnet having sufficient magnetic power to attract and maintain the steel maze ball within the magnetic ball storage hole.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

DESCRIPTION OF THE EXEMPLARY EMBODIMENT

Figure 1:
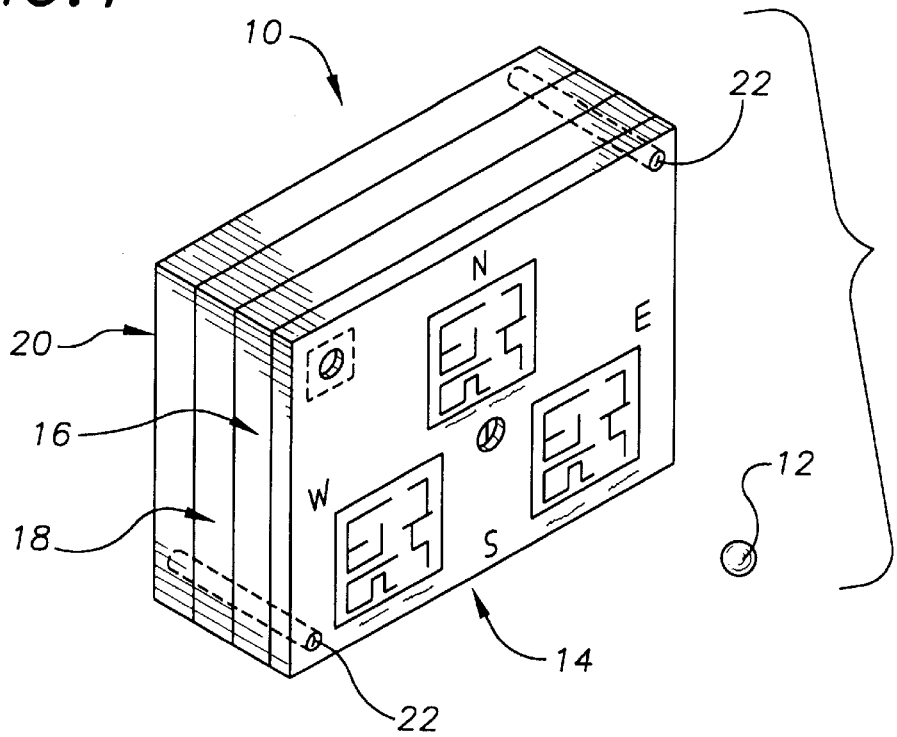
FIG. 1 is a perspective view of an exemplary embodiment of the multi-layer maze assembly of the present invention showing the steel maze ball; top cover member with the magnetic ball storage hole, the ball storage magnet, the ball insertion opening, and the first, second and third maze level maps; the first maze level member; the second maze level member; the third maze level member; and the two maze assembly securing screws.
Figure 2:
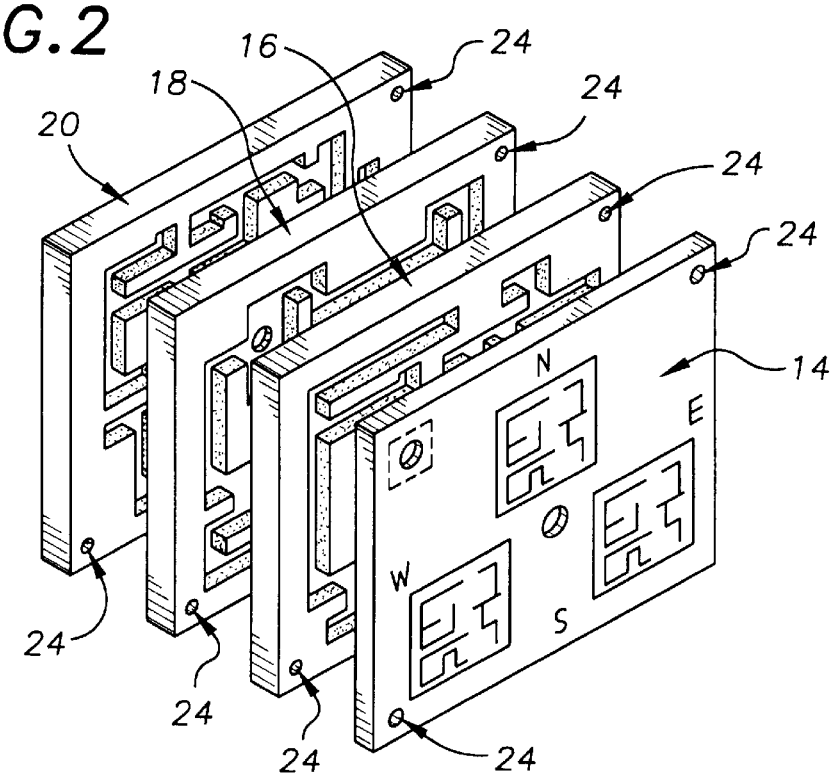
FIG. 2 is an exploded perspective view of the exemplary multi-layer maze assembly of FIG. 1 with the two maze assembly securing screws removed and the top cover member; the first maze level member; the second maze level member; and the third maze level member partially exploded away from each other.

FIG. 1 shows an exemplary embodiment of the multi-layer maze assembly of the present invention generally designated by the numeral 10. In this embodiment, maze assembly 10 includes a steel maze ball 12; a top cover member, generally designated 14; a first maze level member, generally designated 16; a second maze level member, generally designated 18; a third maze level member, generally designated 20; and two maze assembly securing screws 22. Maze assembly screws 22 are used, with reference now to FIG. 2, to secure top cover member 14, first maze level member 16, second maze level member 18; and third maze level member 20 by screwing maze assembly screws 22 (FIG. 1) through the aligned securing apertures 24 of top cover member 14, first maze level member 16, second maze level member 18; and third maze level member 20. In this embodiment, top cover member 14, first maze level member 16, second maze level member 18, and third maze level member 20 are each of molded opaque plastic construction.

Figure 3:
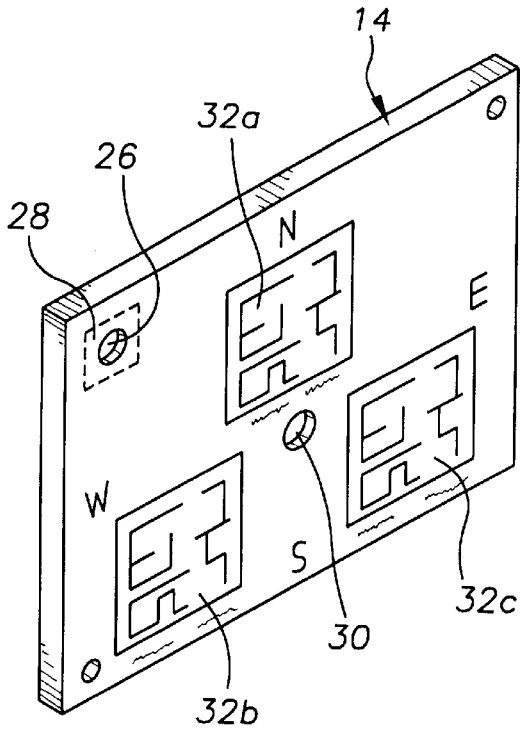
FIG. 3 is a perspective view of the top cover member of FIG. 1 in isolation showing the magnetic ball storage hole; the ball storage magnet; the ball insertion opening; and the first, second and third maze level maps.

With reference to FIG. 3, in this embodiment, top cover member 14 includes a magnetic ball storage hole 26, a ball storage magnet 28 (shown in dashed lines), a ball insertion opening 30, and first, second and third maze level maps 32*a*,32*b*,32*c*. Ball insertion opening 30 is sized to allow passage therethrough of the steel maze ball 12 (FIG. 1). Ball storage magnet 28 has sufficient magnetic power to attract and maintain steel maze ball 12 within magnetic ball storage hole 26.

Figure 4:
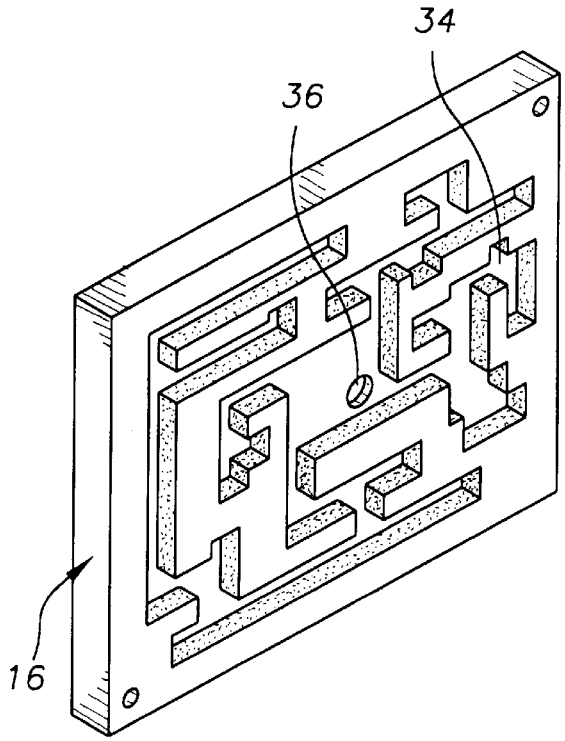
FIG. 4 is a perspective view of the first maze level member in isolation showing the first interconnected maze channels, the two securing apertures, and the first maze ball pass through aperture.

With reference to FIG. 4, first maze level member 16 includes first interconnected maze channels 34 and a first maze ball pass through aperture 36. First maze ball pass through aperture 36 is sized to allow passage therethrough of the steel maze ball 12. When top cover member 14 (FIG. 3) and first maze level member 16 are secured together, ball insertion opening 30 is in connection with first interconnected maze channels 34.

Figure 5:
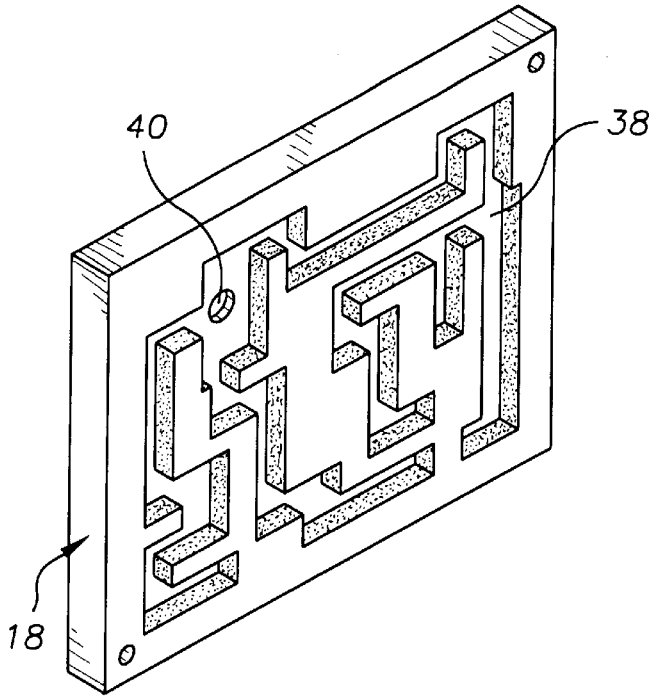
FIG. 5 is a perspective view of the second maze level member in isolation showing the second interconnected maze channels, the two securing apertures, and the second maze ball pass through aperture.

With reference to FIG. 5, second maze level member 18 includes second interconnected maze channels 38 and a second maze ball pass through aperture 40. Second maze ball pass through aperture 40 is sized to allow passage therethrough of the steel maze ball 12. When first maze level member 16 (FIG. 4) and second maze level member 18 are secured together, first maze ball pass through aperture 36 is in connection with second interconnected maze channels 38.

Figure 6:
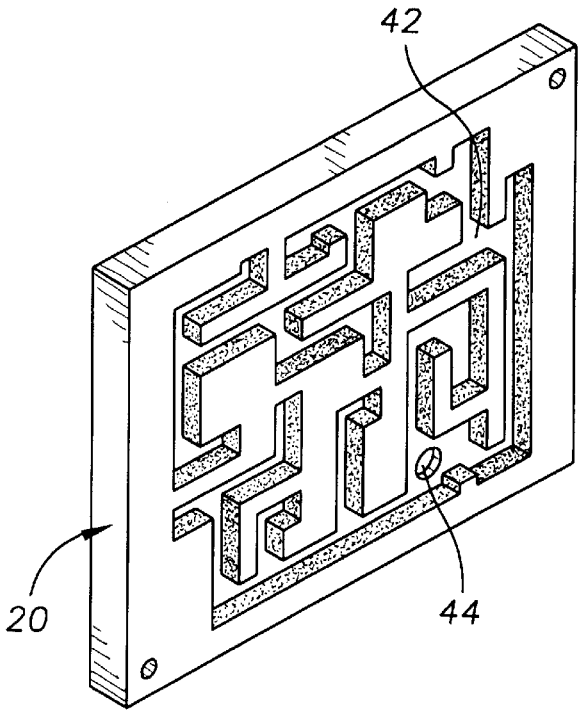
FIG. 6 is a perspective view of the third maze level member in isolation showing the third interconnected maze channels, the two securing apertures, and the third maze ball pass through aperture.

With reference to FIG. 6, third maze level member 20 includes third interconnected maze channels 42 and a third maze ball pass through aperture 44. Third maze ball pass through aperture 44 is sized to allow passage therethrough of the steel maze ball 12. When second maze level member 18 (FIG. 5) and third maze level member 20 are secured together, second maze ball pass through aperture 40 is in connection with third interconnected maze channels 38 and third maze ball pass through aperture 44 is in connection with the exterior of multi-layer maze assembly 10 (FIG. 1).

With general reference to FIGS. 1–6, in use multi-layer maze assembly 10 is used by inserting steel maze ball 12 into ball insertion opening 30 and manipulating multi-layer maze assembly 10 until steel maze ball 12 travels through first maze level member 16, second maze level member 18; and third maze level member 20 and exits maze assembly 10 through third maze ball pass through aperture 44.

It can be seen from the preceding description that a multilayer maze assembly has been provided that has multiple sets of maze channels that are interconnected; and that includes a steel maze ball; a top cover member having a magnetic ball storage hole, a ball storage magnet positioned adjacent to the magnetic ball storage hole, a ball insertion opening sized to allow passage therethrough of the steel maze ball, two securing apertures, and first, second and third maze level maps; a first maze level member including first interconnected maze channels, two securing apertures, and a first maze ball pass through aperture that is sized to allow passage therethrough of the steel maze ball; a second maze level member including second interconnected maze channels, two securing apertures, and a second maze ball pass through aperture that is sized to allow passage therethrough of the steel maze ball; a third maze level member including third interconnected maze channels, two securing apertures, and a third maze ball pass through aperture that is sized to allow passage therethrough of the steel maze ball; and two maze assembly securing screws of each of sufficient length to pass through aligned securing apertures of the top cover member, the first maze level member, the second maze level member, and the third maze level member; the ball insertion opening being in connection with the first interconnected maze channels; the first maze ball pass through aperture being in connection with the second interconnected maze channels; the second maze ball pass through aperture being in connection with the third interconnected maze channels; the third maze ball pass through aperture being in connection with the exterior of the multi-layer game assembly; the ball storage magnet having sufficient magnetic power to attract and maintain the steel maze ball within the magnetic ball storage hole.

It is noted that the embodiment of the multi-layer maze assembly described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A multi-layer maze assembly comprising:

a maze ball;

a top cover member having a ball insertion opening sized to allow passage therethrough of said maze ball, and two securing apertures;

a first maze level member including first interconnected maze channels, two securing apertures, and a first maze ball pass through aperture that is sized to allow passage therethrough of said maze ball;

a second maze level member including second interconnected maze channels, two securing apertures, and a second maze ball pass through aperture that is sized to allow passage therethrough of said maze ball;

a third maze level member including third interconnected maze channels, two securing apertures, and a third maze ball pass through aperture that is sized to allow passage therethrough of said maze ball; and two maze assembly securing screws of each of sufficient length to pass through aligned securing apertures of said top cover member, said first maze level member, said second maze level member, and said third maze level member;

said ball insertion opening being in connection with said first interconnected maze channels;

said first maze ball pass through aperture being in connection with said second interconnected maze channels;

said second maze ball pass through aperture being in connection with said third interconnected maze channels;

said third maze ball pass through aperture being in connection with said exterior of said multi-layer game assembly.

2. The multi-layer maze assembly of claim 1, wherein:

said top cover member has first, second and third maze level maps provided on an exterior surface thereof.

3. The multi-layer maze assembly of claim 2, wherein:

said top cover member, said first maze level member, said second maze level member, and said third maze level member are each constructed of an opaque material.

4. The multi-layer maze assembly of claim 3 wherein:

said top cover member, said first maze level member, said second maze level member, and said third maze level member are each constructed of plastic.

5. The multi-layer maze assembly of claim 4 wherein:

said maze ball is formed of a magnetically attractable steel; and said top cover member has a magnetic ball storage hole and a ball storage magnet positioned adjacent to said magnetic ball storage hole; said ball storage magnet having sufficient magnetic power to attract and maintain said steel maze ball within said magnetic ball storage hole.

6. The multi-layer maze assembly of claim 3 wherein:

said maze ball is formed of a magnetically attractable steel; and said top cover member has a magnetic ball storage hole and a ball storage magnet positioned adjacent to said magnetic ball storage hole; said ball storage magnet having sufficient magnetic power to attract and maintain said steel maze ball within said magnetic ball storage hole.

7. The multi-layer maze assembly of claim 2 wherein:

said top cover member, said first maze level member, said second maze level member, and said third maze level member are each constructed of plastic.

8. The multi-layer maze assembly of claim 7 wherein:

said maze ball is formed of a magnetically attractable steel; and said top cover member has a magnetic ball storage hole and a ball storage magnet positioned adjacent to said magnetic ball storage hole; said ball storage magnet having sufficient magnetic power to attract and maintain said steel maze ball within said magnetic ball storage hole.

9. The multi-layer maze assembly of claim 2 wherein:

said maze ball is formed of a magnetically attractable steel; and said top cover member has a magnetic ball storage hole and a ball storage magnet positioned adjacent to said magnetic ball storage hole; said ball storage magnet having sufficient magnetic power to attract and maintain said steel maze ball within said magnetic ball storage hole.

10. The multi-layer maze assembly of claim 1, wherein:

said top cover member, said first maze level member, said second maze level member, and said third maze level member are each constructed of an opaque material.

11. The multi-layer maze assembly of claim 10 wherein:

said top cover member, said first maze level member, said second maze level member, and said third maze level member are each constructed of plastic.

12. The multi-layer maze assembly of claim 11 wherein:

said maze ball is formed of a magnetically attractable steel; and said top cover member has a magnetic ball storage hole and a ball storage magnet positioned adjacent to said magnetic ball storage hole; said ball storage magnet having sufficient magnetic power to attract and maintain said steel maze ball within said magnetic ball storage hole.

13. The multi-layer maze assembly of claim 10 wherein:

said maze ball is formed of a magnetically attractable steel; and said top cover member has a magnetic ball storage hole and a ball storage magnet positioned adjacent to said magnetic ball storage hole; said ball storage magnet having sufficient magnetic power to attract and maintain said steel maze ball within said magnetic ball storage hole.

14. The multi-layer maze assembly of claim 1 wherein:

said top cover member, said first maze level member, said second maze level member, and said third maze level member are each constructed of plastic.

15. The multi-layer maze assembly of claim 14 wherein:

said maze ball is formed of a magnetically attractable steel; and said top cover member has a magnetic ball storage hole and a ball storage magnet positioned adjacent to said magnetic ball storage hole; said ball storage magnet having sufficient magnetic power to attract and maintain said steel maze ball within said magnetic ball storage hole.

16. The multi-layer maze assembly of claim 1 wherein:

said maze ball is formed of a magnetically attractable steel; and said top cover member has a magnetic ball storage hole and a ball storage magnet positioned adjacent to said magnetic ball storage hole; said ball storage magnet having sufficient magnetic power to attract and maintain said steel maze ball within said magnetic ball storage hole.

* * * * *